United States Patent [19]

Koeln et al.

[11] Patent Number: 4,786,197

[45] Date of Patent: Nov. 22, 1988

[54] TWIST ACTUATED WRITING INSTRUMENT

[75] Inventors: Harold E. Koeln; Michael Lembeck, both of St. Louis County, Mo.

[73] Assignee: Ritepoint, Fenton, Mo. Mo.

[21] Appl. No.: 61,470

[22] Filed: Jun. 15, 1987

[51] Int. Cl.[4] ..... B43K 24/06

[52] U.S. Cl. ..... 401/116; 401/99; 401/109

[58] Field of Search ..... 401/116, 99, 109–114, 401/30

[56] References Cited

U.S. PATENT DOCUMENTS

| | | | |
|---|---|---|---|
| 2,826,173 | 3/1958 | Gossweiler et al. | 401/116 |
| 3,169,511 | 2/1965 | Spatz | 401/116 X |
| 3,679,318 | 7/1972 | Liguori | 401/110 |
| 3,792,931 | 2/1974 | Ganz | 401/109 |
| 4,221,490 | 9/1980 | Malm | 401/116 X |
| 4,270,869 | 6/1981 | Sekiguchi | 401/30 |
| 4,738,557 | 4/1988 | Yumoto | 401/109 X |

FOREIGN PATENT DOCUMENTS

| | | | |
|---|---|---|---|
| 199539 | 9/1958 | Austria | 401/111 |

*Primary Examiner*—Richard J. Apley
*Assistant Examiner*—Franklin L. Gubernick
*Attorney, Agent, or Firm*—Edward R. Weber

[57] ABSTRACT

A twist actuated writing instrument comprised of a barrel, a cap, a two-directional cam, and an actuator wherein the barrel, the cap, the two-directional cam, and the actuator axially encase a writing element and a spring and wherein the cap may be rotated in either a clockwise or counterclockwise direction relative to the barrel, such that when the cap is rotated in either direction relative to the barrel, the writing element will be advanced to the writing position and when the cap is rotated in the opposite direction relative to the barrel, the writing element will retract.

18 Claims, 1 Drawing Sheet

TWIST ACTUATED WRITING INSTRUMENT

FIELD OF THE INVENTION

The present invention elates to ball point pens, and more particularly, to an improved means for extension and retraction whereby the writing element may be extended and retracted by rotation of the cap in either direction relative to the barrel of the writing instrument.

BACKGROUND OF THE INVENTION

Conventional ball point pens of the type which provide for the extension and retraction of the writing element have generally been of two types. One type utilizes a push button mechanism wherein the writing element is extended when the mechanism is depressed and is retracted when the mechanism is pushed a second time thereby releasing a catch which has been holding the writing element in the extended position. A second type allows the extension or retraction of the writing element by rotation of the cap in a preselected direction, either clockwise or counterclockwise, relative to the barrel of the writing instrument. Rotation of the cap in the opposite direction causes the writing instrument to retract.

Unfortunately ball point pens of the second type have oftentimes presented a number of drawbacks. These have typically included complicated and/or expensive construction, inconvenient operation, and a failure to address the convenience of both right-handed and left-handed users. It is therefore among the objects of the invention to provide a writing instrument which is mechanically simple, inexpensive to manufacture, reliable, and convenient and easy to use by both right-handed and left-handed individuals. Other objects and features will be in part apparent and in part pointed out hereinafter.

SUMMARY OF THE INVENTION

The present invention is comprised of a barrel, a cap, and an actuator into which a conventional writing cartridge encircled with a spring is axially enclosed. The barrel has a substantially tubular portion (hereinafter called the tubular end) which mates with the cap and a tapered portion (hereinafter called the tip) opposite the tubular end through which the writing cartridge extends. The tubular end is formed to incorporate means for engaging and retaining the cap such that the cap may freely rotate relative to the barrel. This means allows the cap to be freely rotated in either a clockwise or counterclockwise direction relative to the barrel and maintains the barrel and cap in fixed, linear relation. The tubular end of the barrel id formed internally with a plurality of splines which mate with similar splines on the actuator. These mating splines permit the actuator to move laterally within the barrel but prevent the actuator from rotating with respect to the barrel. The interior of the tip of the barrel is formed to have a reduced diameter portion near the opening through which the writing cartridge extends. This reduced diameter portion abuts the spring encircling the writing cartridge. The resulting compression of the spring maintains a positive relationship between the barrel, writing cartridge, and actuator.

The cap has a tubular end and a closed end. The tubular end incorporates means which engage complementary means on the tubular end of the barrel whereby the cap and barrel are free to rotate in either direction relative to each other, but are maintained in a fixed, linear relationship. The interior of the tubular end of the cap is additionally formed to incorporate a two-directional cam. The cam is so located within the cap that when the cap and barrel are in a mated, rotating relationship, a cam follower portion of the actuator will engage the two-directional cam.

The actuator has a plurality of splines, which are sized to slidably mate with the splines of the barrel, and a solid portion having a cam follower formed thereon. When the writing instrument is assembled, the splines of the actuator mate with the splines of the tubular end of the barrel thereby preventing rotation of the actuator relative to the barrel. The solid portion mates with the cap in such a fashion that the cam follower engages the two-directional cam. Thus when the cap is rotated relative to the barrel and actuator in either a clockwise or counterclockwise direction, the actuator will move in a lateral direction within the cap-barrel assembly thereby causing the writing cartridge, the non-writing end of which abuts the actuator, to advance or retract. The two-directional cam is additionally provided with a detent means whereby the cam follower mates with said detent means providing a positive resistance to rotation when the writing element is in an advanced position suitable for writing and further preventing unintentional retraction of the writing element caused by pressure on the writing tip.

In use, either a right-handed or a left-handed individual may utilize the writing instrument of the present invention with ease and comfort since there exists no predetermined direction in which the cap must be rotated relative to the barrel to effect extension of the writing cartridge. The user simply rotates the cap in a direction comfortable to the individual thereby initiating the cam follower to follow either surface of the two-directional cam to the detent means. Similarly the user may rotate the cap in an opposite direction to effect the retraction of the writing cartridge.

As will be readily apparent, the present invention is mechanically simple and inexpensive to manufacture as well as being convenient and easy to use by both right-handed and left-handed individuals.

DETAILED DESCRIPTION OF THE DRAWINGS

Figure 1:
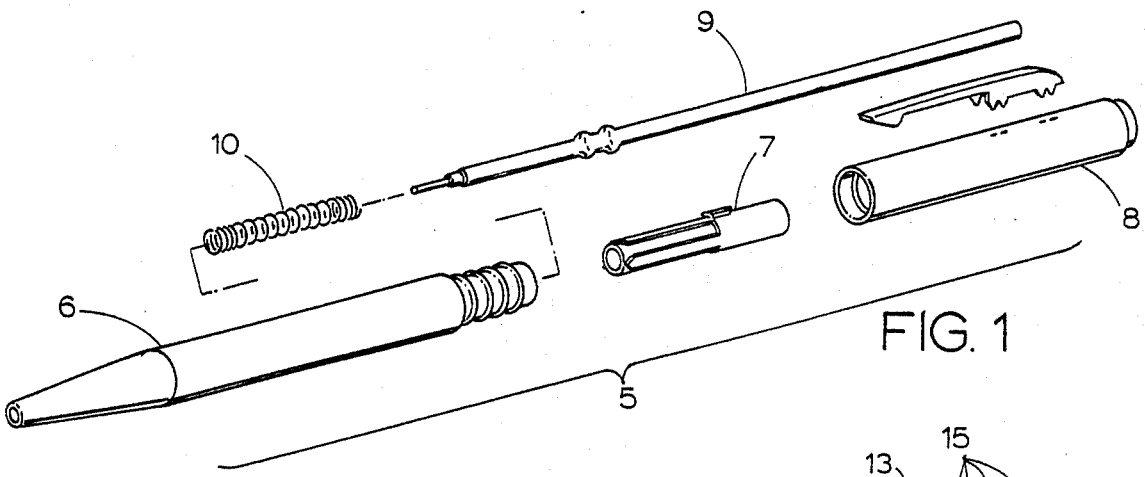
FIG. 1 is an exploded view of the twist retractable writing instrument of the present invention.

Referring now to the drawings wherein like reference characters represent like elements, FIG. 1 shows an exploded view of a writing instrument 5 comprised of a barrel 6, an actuator 7, and a cap 8 in which a conventional writing cartridge 9 with an accompanying spring 10 are axially enclosed.

Figure 2:
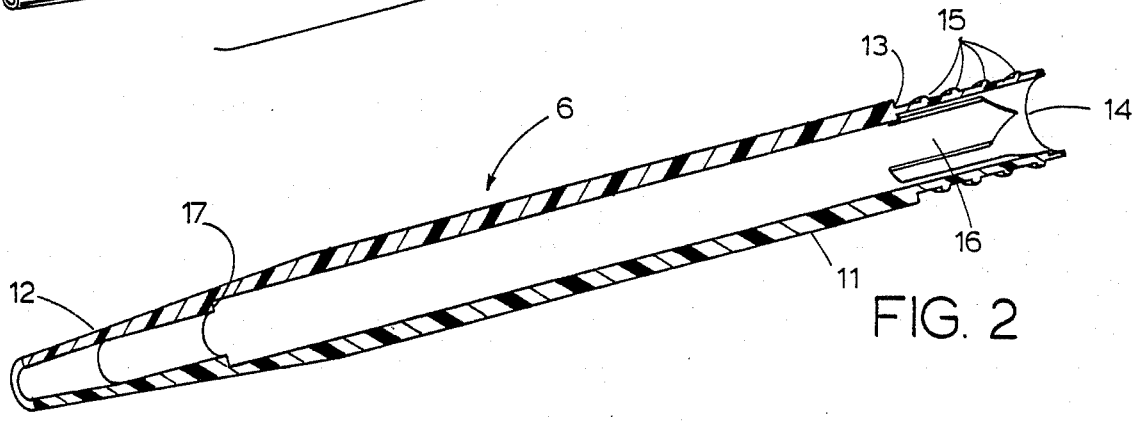
FIG. 2 is a sectional view of the barrel of the present invention showing the means for engaging the cap and the internal structure.

FIG. 2 illustrates barrel 6 which is comprised of a tubular end 11, which mates with cap 8, and a tip end 12, which is tapered and through which writing cartridge 9 extends when it is in the writing position. Tubular end 11 reduces via a shoulder 13 to a reduced diameter portion 14. Reduced diameter portion 14 is formed to incorporate a plurality of raised, annular ribs 15. Ribs 15 mate with complementary ribs formed in cap 8 and allow cap 8 to be rotated in either a clockwise or counterclockwise direction relative to barrel 6 while maintaining barrel 6 and cap 8 in mated relation. Tubular end 11 is also formed internally with a plurality of splines 16 which maintain the relation between barrel 6 and actuator 7 and prohibit rotational movement of actuator 7 relative to barrel 6. Tip end 12 is further formed internally to have a shoulder 17 which abuts spring 10. When assembled, spring 10 is partially compressed and maintains a positive relationship between barrel 6, writing cartridge 9, and actuator 7.

Figure 3:
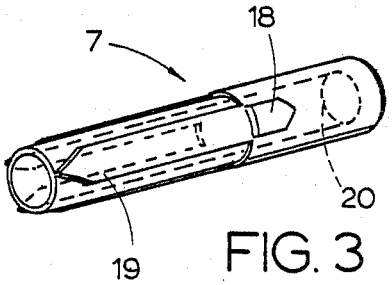
FIG. 3 is a top view of the actuator showing the cam follower and splines.
Figure 4:
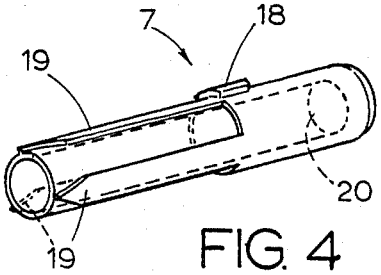
FIG. 4 is a side view of the actuator further illustrating the cam follower and splines.

FIGS. 3 and 4 illustrate actuator 7 which is formed externally to incorporate a plurality of splines 19 and a cam follower 18 adjacent thereto. Actuator 7 is open at one end to receive the non-writing end of writing cartridge 9 and closed at the opposite end; interior surface 20 of the closed end maintains the relationship of writing cartridge 9 relative to barrel 6. When writing instrument 5 is assembled, splines 19 of actuator 7 mate with splines 16 of barrel 6 thereby preventing actuator 7 from rotating relative to barrel 6. Actuator 7, which is of a somewhat smaller diameter than cap 8, fits within cap 8 such that cam follower 18 bears upon two-directional cam 22 (see FIG. 5). Rotation of cap 8 relative to barrel 6 and actuator 7 in either a clockwise or counterclockwise direction causes writing cartridge 9 to advance or permits it to retract.

Figure 5:
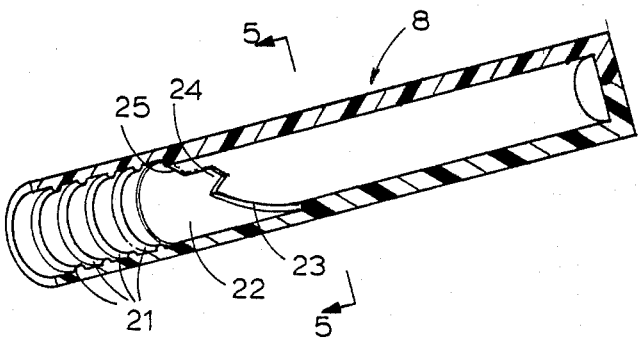
FIG. 5 is a sectional view of the cap showing means for engaging the barrel and the internal structure.

FIG. 5 illustrates cap 8 which is formed internally to incorporate a plurality of raised, annular ribs 21 and a two-directional cam 22 located adjacent thereto. Raised, annular ribs 21 are spaced correlatively to raised, annular ribs 15 of reduced diameter portion 14 of barrel 6 such that when writing instrument 5 is assembled, cap 8 and barrel 6 are maintained in mated relation and allowed to rotate freely in either direction relative to each other. Cam 22 is shaped such that cam follower 18 may follow along surface 23 or **23*a* (see FIG. 6) to detent 24 or 24*a* (see FIG. 6). When cam follower 18 is in either detent 24 or 24*a*, writing cartridge 9 is in the extended position suitable for writing. By reversing the twisting action of cap 8 relative to barrel 6, cam follower 18 will move out of detent 24 or 24*a* and follow along surface 23 or 23*a* and writing cartridge 9 will be caused to retract into barrel 6 by the action of spring 10**.

Figure 6:
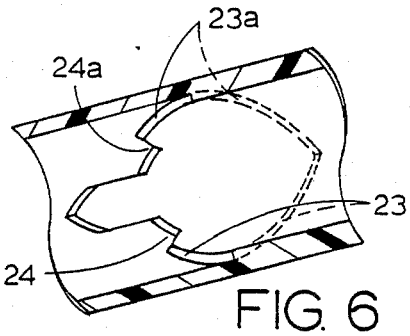
FIG. 6 is a developed view of the two-directional cam along line 5—5.

FIG. 6 further illustrates two-directional cam 22 formed within cap 8.

From the foregoing description, it will be readily understood that when writing instrument 5 is assembled, cap 8 can be rotated in either a clockwise or counterclockwise direction relative to barrel 6. When cap 8 is rotated in one direction, cam follower 18 will move along surface 23 or **23*a* from its resting position into detent 24 or 24*a*. As this occurs, writing cartridge 9, which abuts surface 20 of actuator 7, is moved to its extended position. When cap 8 is rotated in a second direction, the procedure will reverse such that cam follower 18 will move away from detent 24 or 24*a* and along surface 23 or 23*a* to a resting position thereby permitting writing cartridge 9** to retract.

The present invention has been described without reference to any decorative features. As is obvious, bands, button closures, clips, etc., may be added as desired. To allude to the many decorative features which may be added to the pen, FIG. 1 includes a clip which is seen to attach to the cap of the present invention.

Although the present invention has been described and illustrated with respect to a preferred embodiment thereof, it is to be understood that it is not to be so limited since changes and modifications may be made therein which are within the full intended scope of this invention as hereinafter claimed.

What is claimed is:

1. A twist actuated writing instrument comprised of a barrel, a cap, and an actuator and means for maintaining the linear relationship between said barrel and said cap, wherein said barrel, said cap, and said actuator axially encase a writing element and a spring means; said barrel having a first end and a second end, said first end having means for engaging and retaining said cap, and a plurality of circumferentially spaced splines which slidably engage with corresponding circumferentially spaced splines on said actuator, and said second end having an opening through which said writing element may be caused to protrude, said second end further having an internal abutment which interacts with said spring means; said cap having a first end and a second end, said first end being constructed to mate with the first end of said barrel and incorporating engaging and retaining means which engage complementary means on said first end of said barrel, whereby said cap is permitted to rotate with respect to said barrel but is restrained from moving laterally with respect to said barrel, and two-directional cam means, said two-directional cam means being further provided with detent means to ensure positive resistance to rotation of the cap when said writing element is in the extended, writing position; said actuator also having a cam follower which mates with said two-directional cam of said cap whereby said follower can travel on the cam in both a clockwise and counterclockwise direction, and said actuator further having an actuating surface which abuts the non-writing end of said writing element; said twist actuated writing instrument axially enclosing said writing element and said spring means wherein said writing element is maintained in positive relationship between said second end of said barrel and said actuating surface of said actuator and wherein either clockwise or counterclockwise rotation of said cap with respect to said barrel will produce lateral movement of said actuator, which in turn will cause the writing end of said writing element to protrude from said second end of said barrel and opposite rotation will cause the writing end of said writing element to retract with respect to said second end of said barrel.

2. A twist actuated writing instrument according to claim 1 wherein the means for engaging and retaining said cap on said barrel consists of a plurality of raised, annular ribs on said first end of said barrel which interact with a complementary plurality of raised, annular ribs inside said first end of said cap whereby said barrel is maintained in fixed, linear relationship with said cap and is allowed to rotate freely in either a clockwise or counterclockwise direction relative to said cap.

3. A twist actuated writing instrument according to claim 1 wherein said barrel mates with said actuator such that said plurality of splines of said first end of said barrel slidably engage splines on said actuator whereby said actuator is allowed to move laterally with respect to said barrel but is prevented from rotating relative to said barrel.

4. A twist actuated writing instrument according to claim 1 wherein said actuator mates with said cap such that said cam follower of said actuator engages the surface of said two-directional cam of said cap whereby rotation of said cap relative to said barrel in either direction will actuate the cam follower to move along the two-directional cam to said detent means moving said actuator laterally within said cap/barrel assembly causing said writing element to extend to the writing position and rotation of the cap relative to aid barrel in the opposite direction will actuate the cam follower to move along the two-directional cam away from said detent means moving said actuator laterally within said cap/barrel assembly causing said writing element to retract within the cap/barrel assembly.

5. A twist actuated writing instrument according to claim 1 wherein said writing element has an abutment adjacent to the writing tip.

6. A twist actuated writing instrument according to claim 5 wherein said spring means consists of a helical spring coaxially surrounding said writing element and is positioned between said abutment of said writing element and said abutment of said second end of said barrel and maintains a positive lateral relationship between said actuator, said barrel, and said writing element such that when said cap is rotated relative to said barrel in either direction, said actuator will overcome the resistance of said helical spring and advance said writing element to the writing position and when said cap is rotated relative to said barrel in the opposite direction, said actuator will allow said spring to return to its normal state thereby causing the writing element to retract.

7. A twist actuated writing instrument comprised of a barrel, a cap, and an actuator and means for maintaining the relationship between said barrel and said cap, wherein said barrel, said cap, and said actuator are tubular and in which a writing element and an helical spring are coaxially enclosed; said barrel having a first tubular end and a second tapered end, said first tubular end having means for engaging and retaining said cap and a plurality of circumferentially spaced splines which with corresponding circumferentially spaced slidably engage splines on said actuator, and said second tapered end converging to an opening tip and having an internal abutment adjacent said tip; said cap having a tubular end and a closed end, said tubular end of said cap having an inside diameter substantially the same as the outside diameter of said barrel adjacent said first tubular end of said barrel and having retain ing means which engage said engaging and retaining means on said first tubular end of said barrel and two-directional cam means formed on the interior surface of said cap, said two-directional cam means provided with detent means to provide positive resistance to rotation of said cap when said writing element is in the extended, writing position; said actuator also having a cam follower which mates with said two-directional cam of said cap whereby said follower can travel on the cam in both a clockwise and counterclockwise direction, and said actuator further having an actuating surface which abuts the non-writing end of said writing element which is axially enclosed within said barrel; said twist actuated writing instrument coaxially enclosing said writing element and said helical spring wherein said writing element is maintained in positive relationship between said second tapered end of said barrel and said actuating surface of aid actuator and wherein either clockwise or counterclockwise rotation of said cap with respect to said barrel will produce lateral movement of said actuator, which in turn will cause the writing end of said writing element to protrude from said opening tip in said second tapered end of said barrel and rotation of said cap in the opposite direction will cause the writing end of said writing element to retract with respect to said second tapered end of said barrel.

8. A twist actuated writing instrument according to claim 7 wherein the means for engaging and retaining said cap on said barrel consists of a plurality of raised, annular ribs on said first tubular end of said barrel which interact with a complementary plurality of raised, annular ribs inside said tubular end of said cap whereby said barrel is maintained in fixed, linear relationship with said cap and is allowed to rotate freely in either a clockwise or counterclockwise direction relative to said cap.

9. A twist actuated writing instrument according to claim 7 wherein said barrel mates with said actuator such that said plurality of splines of said first tubular end of said barrel slidably engage splines on said actuator whereby said actuator is allowed to move laterally with respect to said barrel but is prevented from rotating relative to said barrel.

10. A twist actuated writing instrument according to claim 7 wherein said actuator mates with said cap such that said cam follower of said actuator engages the surface of said two-directional cam of said cap whereby rotation of said cap relative to said barrel in either direction will actuate the cam follower to move along the two-directional cam to either of said detent means moving said actuator laterally within said cap/barrel assembly causing said writing element to extend to the writing position and rotation of the cap relative to said barrel in the opposite direction will actuate the cam follower to move along the two-directional cam away from said detent means moving said actuator laterally within said cap/barrel assembly causing said writing element to retract within the cap/barrel assembly.

11. A twist actuated writing instrument according to claim 7 wherein said writing element has an abutment adjacent to the writing tip.

12. A twist actuated writing instrument according to claim 11 wherein said helical spring coaxially surrounds said writing element and is positioned between said abutment of said writing element and said internal abutment adjacent said second tapered end of said barrel and maintains a positive lateral relationship between said actuator, said barrel, and said writing element such that when said cap is rotated relative to said barrel in either direction, said actuator will overcome the resistance of said helical spring and advance said writing element to the writing position and when said cap is rotated relative to said barrel in the opposite direction, said actuator will allow said spring to return to its normal state thereby causing the writing element to retract.

13. A twist actuated writing instrument comprised of a barrel, a cap, and an actuator and means for maintaining the relationship between said barrel and said cap, wherein said barrel, said cap, and said actuator are tubular and axially encase a writing element and a spring means; said barrel having a first tubular end and a second tapered end, said first tubular end having a reduced diameter portion incorporating retention means on its external surface for engaging and retaining said cap, and a plurality of splines on its internal surface, which mate with a plurality of corresponding splines on said actuator, and said second tapered end converging to an opening tip and having an internal abutment shoulder adjacent said tip; said cap having a tubular end and a closed end, said tubular end having an outside diameter substantially the same as the outside diameter of said barrel adjacent said reduced diameter portion of said first tubular end of said barrel and an inside diameter complementary to the outside diameter of said barrel in said reduced diameter portion and having retention means on its internal surface which engage said retention means on said reduced diameter portion of said first tubular end of said barrel and a two-directional cam formed on the interior of said cap adjacent said retention means, said two-directional cam provided with detent means to ensure positive resistance to rotation of the cap when said writing element is in the extended, writing position; said actuator having a first open end and a second closed end, said first open end incorporating said plurality of splines on its externals surface, which slidably engage said plurality of splines on the interior surface of said reduced diameter portion of said tubular end of said barrel, and a cam follower adjacent said splines, which mates with said two-directional cam on the interior of said cap whereby aid follower can travel on the cam in both a clockwise and counterclockwise direction, and said second closed end having an actuating surface which abuts the non-writing ends of said writing element which is axially enclosed within said barrel and said actuator; and said sprung means is a helical spring which maintains a positive relationship between said writing element, said abutment shoulder of said tapered end of said barrel and said actuating surface of said closed end of said actuator and wherein either clockwise or counterclockwise rotation of said cap with respect to said barrel will produce lateral movement of said actuator, which in turn will cause the writing end of said writing element to protrude from said second tapered end of said barrel and subsequent rotation of said cap in the opposite direction will cause the writing end of said writing element to retract with respect to said second end of said barrel.

14. A twist actuated writing instrument according to claim 13 wherein the retention means for engaging and retaining said cap on said barrel consists of a plurality of raised, annular ribs on the reduced diameter portion of said tubular end of said barrel which interact with a complementary plurality of raised, annular ribs inside said tubular end of said cap whereby said barrel in maintained in fixed, linear relationship with said cap and is allowed to rotate freely in either a clockwise or counterclockwise direction relative to said cap.

15. A twist actuated writing instrument according to claim 13 wherein said barrel mates with said actuator such that said plurality of splines inside said reduced diameter portion of said tubular end of said barrel slidably engage said plurality of splines on said open end of said actuator whereby said actuator is allowed to move laterally inside said barrel but is prevented from rotating relative to said barrel.

16. A twist actuated writing instrument according to claim 13 wherein said actuator mates with said cap such that said cam follower of said actuator engages the surface of said two-directional cam of said cap whereby rotation of said cap relative to said barrel in either direction will actuate said cam follower to move along said two-directional cam to either of said detent means moving said actuator laterally within said cap/barrel assembly causing said writing element to extend to the writing position and rotation of said cap relative to said barrel in the opposite direction will actuate said cam follower to move along said two-directional cam away from said detent means moving said actuator laterally within said cap/barrel assembly causing said writing element to retract within the cap/barrel assembly.

17. A twist actuated writing instrument according to claim 13 wherein said writing element has an abutment shoulder adjacent to the writing tip.

18. A twist actuated writing instrument according to claim 17 wherein said helical spring coaxially surrounds said writing element and is positioned between said abutment shoulder of said writing element and said abutment shoulder of said tapered end of said barrel and maintains a positive lateral relationship between said actuator, said barrel, and said writing element such that when said cap is rotated in either direction relative to said barrel, said actuator will overcome the resistance of said helical spring and advance said writing element to the writing position and when said cap is rotated relative to said barrel in the opposite direction, said actuator will allow said spring to return to its normal state thereby causing said writing element to retract.

* * * * *

UNITED STATES PATENT AND TRADEMARK OFFICE

CERTIFICATE OF CORRECTION

PATENT NO. : 4,786,197

DATED : Nov. 22, 1988

INVENTOR(S) : Harold E. Koeln; Michael Lembeck

It is certified that error appears in the above-identified patent and that said Letters Patent is hereby corrected as shown below:

Column 1, line 54: Delete the word "id" and insert therefor "is".

Column 5, line 48: After the word "which", insert the words "slidably engage".

Column 5, line 49: After the word "spaced", delete the words "slidably engage".

Column 5, line 56: Delete the words "retain ing" and insert therefor "retaining".

Column 7, line 5: After the word "of", insert "circumferentially spaced".

Column 7, line 6: After the word "corresponding", insert the words "circumferentially spaced".

Column 7, line 25: Delete the word "externals" and insert therefor "external".

UNITED STATES PATENT AND TRADEMARK OFFICE

CERTIFICATE OF CORRECTION

PATENT NO. : 4,786,197

DATED : Nov. 22, 1988

INVENTOR(S) : Harold E. Koeln; Michael Lembeck

It is certified that error appears in the above-identified patent and that said Letters Patent is hereby corrected as shown below:

Column 7, line 30: Delete the word "aid" and insert therefor "said".

Column 7, line 33: Delete the word "ends" and insert therefor "end".

Column 7, line 35: Delete the word "sprung" and insert therefor "spring".

Signed and Sealed this

Fourth Day of April, 1989

*Attest:*

*Attesting Officer*

DONALD J. QUIGG

*Commissioner of Patents and Trademarks*